US005312285A

United States Patent [19]

Rieber et al.

[11] Patent Number: 5,312,285

[45] Date of Patent: May 17, 1994

[54] DESCENDING BALL GAME APPARATUS

[75] Inventors: Frederick M. Rieber, Rehoboth, Mass.; Joseph P. Sejnowski, Cumberland, R.I.

[73] Assignee: Playskool, Inc., Del.

[21] Appl. No.: 940,480

[22] Filed: Sep. 4, 1992

[51] Int. Cl.[5] ..... A63H 29/08; A63F 9/14; A63B 67/14; A63D 3/00

[52] U.S. Cl. ..... 446/168; D21/19; D21/143; 273/86 C; 273/109; 273/118 R

[58] Field of Search ..... 446/168, 169, 170, 171, 446/172, 173, 174, 166, 167; 273/86 C, 86 R, 86 E, 109, 110, 113, 111, 118 R, 121; D21/19, 59, 143

[56] References Cited

U.S. PATENT DOCUMENTS

| | | | |
|---|---|---|---|
| D. 230,291 | 2/1974 | Karen . | |
| D. 290,026 | 5/1987 | Wichman . | |
| D. 290,028 | 5/1987 | Wichman . | |
| D. 290,143 | 6/1987 | Wichman . | |
| D. 290,145 | 6/1987 | Wichman . | |
| D. 293,696 | 1/1988 | Wichman . | |
| D. 294,044 | 2/1988 | Wichman . | |
| D. 294,959 | 3/1988 | Wichman . | |
| 2,058,202 | 10/1936 | Anderson | 273/111 |
| 2,729,914 | 1/1956 | Cook . | |
| 2,838,870 | 6/1958 | Morse . | |
| 3,296,714 | 1/1967 | Klotz | 446/116 X |
| 3,452,989 | 1/1969 | Jernstrom | 446/116 X |
| 3,475,023 | 10/1969 | Fauvelle | 446/116 X |
| 4,713,038 | 12/1987 | Wichman et al. | 446/168 |
| 4,932,917 | 6/1990 | Klitsner . | |
| 5,174,569 | 12/1992 | Ngai | 273/86 R |

FOREIGN PATENT DOCUMENTS 1405105 9/1975 United Kingdom .

*Primary Examiner*—David N. Muir

*Attorney, Agent, or Firm*—Salter, Michaelson & Benson

[57] ABSTRACT

A descending ball game apparatus includes a gate deflect channel member and a pivoting ramp channel member. The gate deflect channel member includes two gates which are positioned adjacent to opposing sidewalls of a channel portion thereof and are operative for deflecting a ball back-and-forth from one sidewall of the channel portion to the other sidewall thereof as the ball descends along the channel portion. The pivoting ramp channel member includes upper and lower level channel segments and a pivoting ramp positioned therebetween. The ramp is operative for receiving a ball descending along the upper level of the channel segment and delivering the ball into the lower level channel segment.

15 Claims, 3 Drawing Sheets

DESCENDING BALL GAME APPARATUS

BACKGROUND OF THE INVENTION

The instant invention relates to toy games and more particularly to a descending ball game apparatus of the type including a ball and a plurality of downwardly sloped channel members which are interconnected by a plurality of columns.

Descending ball game apparatus in which balls gravitate downwardly along continuous paths are well known in the art. For example, the Cook U.S. Pats. No. 2,729,914; Morse No. 2,838,870; Wichman et al No. 4,713,038; Klitsner No. 4,932,917 and the British Patent to Karen No. 1,405,105 disclose various types and configurations of unitary and modular descending ball game apparatus.

It has been found that modular descending ball game apparatus have a particularly high play value because they are enjoyable to assemble in various configurations, and further because they are enjoyable to watch as the balls thereof descend through the columns and channels thereof. However, it has been found that one shortcoming in many of the prior art game devices resides in the fact the balls thereof travel along paths at a very rapid pace, and that the balls must be continually restarted for observers gain further enjoyment. In order to increase the play value of the heretofore available descending ball game apparatus various channel configurations have been developed which either lengthen the paths of balls, or provide increased action movements of balls thereby lengthening the time it takes for balls to descend through the game apparatus. In this regard, the Karen U.S. Pat. Nos. Des.230,291; and Wichman Nos. Des.290,026; Des.290,028; Des.290,143; Des.290,145; Des.293,696; Des.294,044; and Des.294,959 disclose several designs of representative channel sections which, in addition to the other hereinabove cited patent documents, represent the closest prior art to the subject invention of which the applicant is aware. Thus, it has been found that by slowing down the speed of a descending ball of a game apparatus of this type and by providing increased action movements of the ball the ability of a device of this type to provide significant visual amusement for a prolonged period of time is substantially increased.

SUMMARY OF THE INVENTION

The instant invention provides a modular descending ball game apparatus which incorporates a gate deflect channel member and a pivoting ramp channel member. Briefly, the descending ball game apparatus comprises a base structure and a plurality of interconnecting channel members and column sections which are adapted to be arranged in various configurations on the base structure to form one or more continuous paths through which a ball can travel downwardly. The entrance and exit columns of the channel members are configured so that the lower end of an exit column of one channel member can only be interconnected with the upper end of an entrance column of another channel member. This feature ensures that the channel members are assembled in a continuous track and thus prevents the channel members from being assembled in an incorrect manner. One or more funnel sections are provided for easy starting of the balls at the top of the columns. Specifically, the gate deflect channel member of the subject invention comprises a widened channel portion having two vertical gates which are operative for deflecting a descending ball back-and-forth from one side of the channel portion to the other side as it passes therethrough. The pivoting ramp channel member includes upper and lower level channel segments and a pivoting ramp element positioned therebetween. As a ball descends along the upper level segment of the channel, the ramp receives the ball and pivots downwardly to deliver the ball to the lower level channel segment.

It is therefore an object of the instant invention to provide a descending ball game apparatus having various channel members which slow the speed of a ball passing therethrough.

It is still another object to provide a descending ball game which is configured so that the channel members cannot be assembled in an incorrect manner.

It is another object of the instant invention to provide a descending ball game apparatus having various channel members which increase the action movements of a ball as it descends through the game.

It is yet another object to provide a descending ball game apparatus having various channel members which increase the visual enjoyment of watching a ball descend through the game apparatus.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
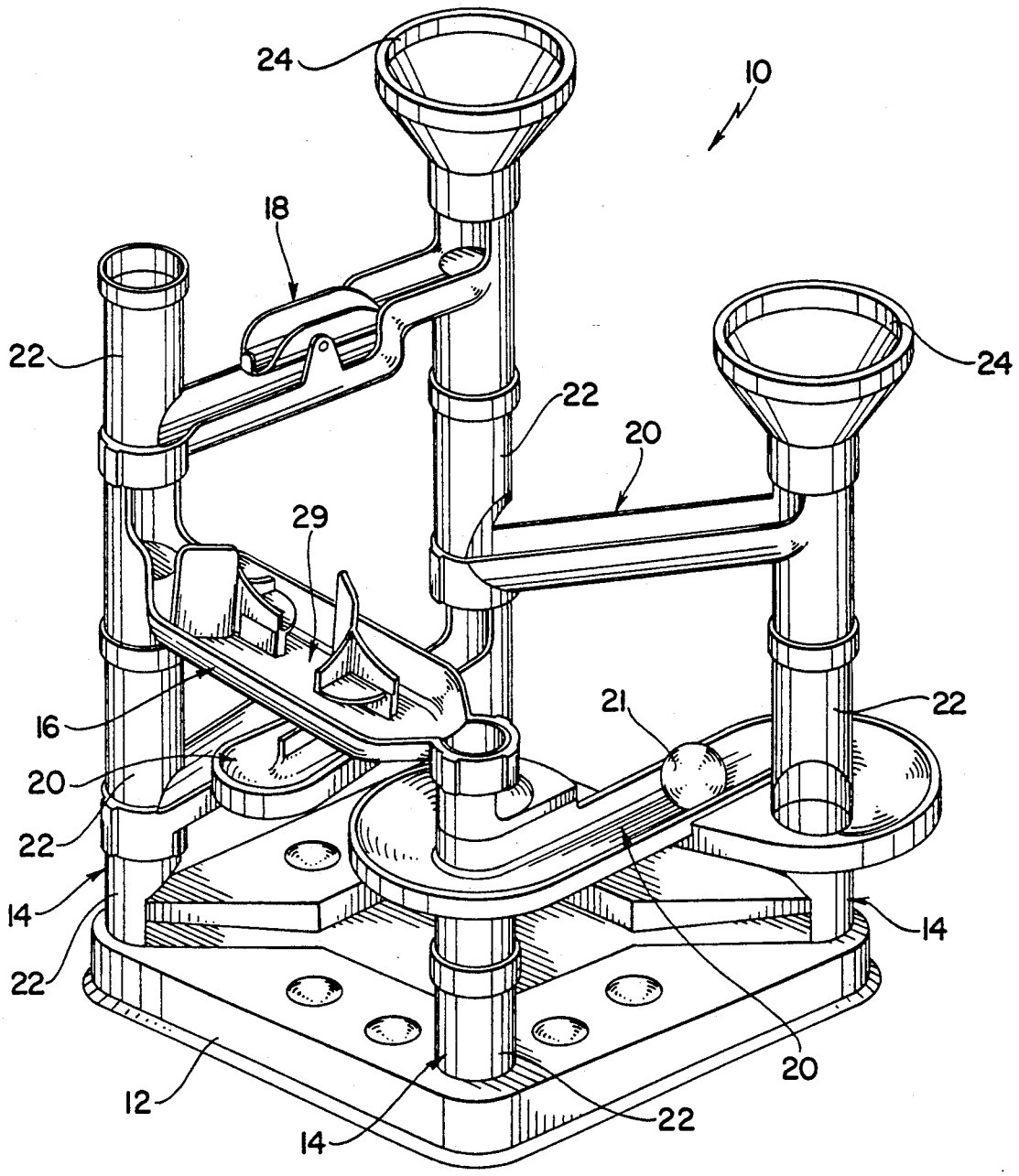
FIG. 1 is a perspective view of the descending ball game apparatus of the instant invention.

Referring now to the drawings, and particularly to FIG. 1, the modular descending ball game apparatus of the instant invention is illustrated and is generally indicated at 10. The game apparatus 10 comprises a base 12 which is adapted for supporting a plurality of columns generally indicated at 14 thereon, a gate deflect channel member generally indicated at 16, a pivoting ramp channel member generally indicated at 18, a plurality of other channel members generally indicated at 20 and at least one ball 21. The channel members 16, 18, and 20 are interconnected to form continuous paths through the game apparatus, and they are supported by the column elements 22. In addition, two funnel elements 24 are provided for more easily starting the descents of the ball 21 at the upper ends of the columns 14. As is clearly illustrated in FIGS. 2 and 4, each of the channel members 16, 18, and 20 includes an entrance column 26 and an exit column 28, each having upper and lower ends which are configured for mating engagement with the respective upper and lower ends of entrance and exit columns of the other channel members 16, 18, and 20. The upper and lower ends of the column elements 22 are also configured for mating engagement with the upper and lower ends of the entrance and exit columns of the channel members 16, 18, and 20. As Illustrated in FIG. 1 the entrance and exit columns 26 and 28 of the channel members 16, 18, and 20 and the upper and lower ends of the column elements 22 matingly interconnect to define a plurality of continuous paths along which a ball can travel downwardly through the game apparatus 10.

Figure 2:
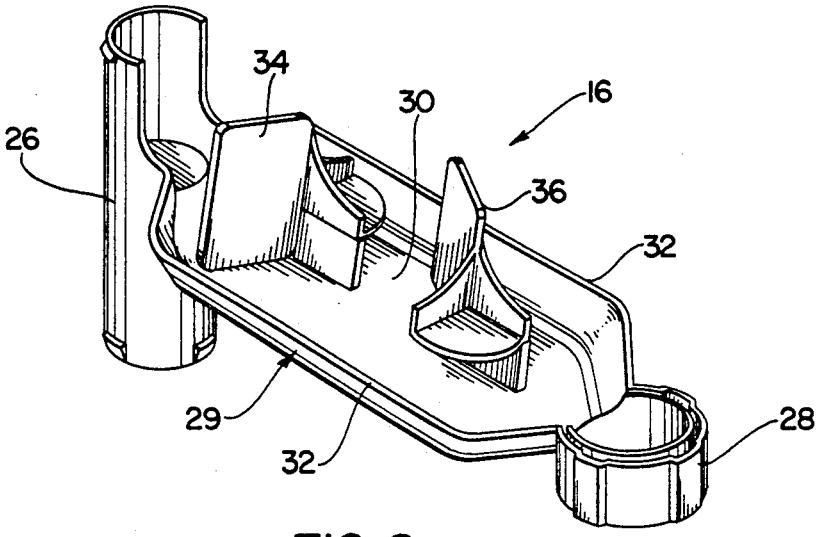
FIG. 2 is a perspective view of the gate deflect channel member of the instant invention.
Figure 4:
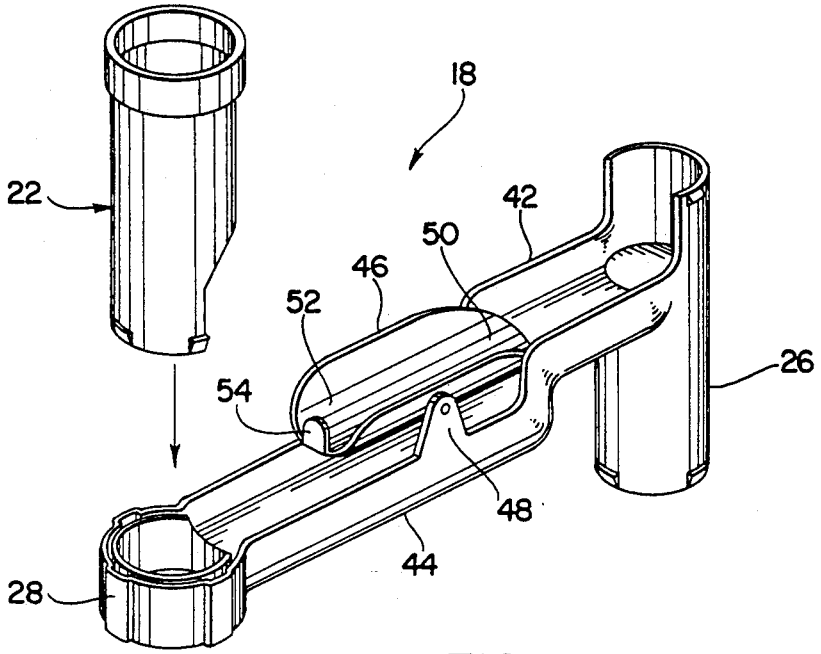
FIG. 4 is a perspective view of the pivoting ramp channel member of the instant invention.

It is pointed out that the upper and lower ends of the entrance columns are configured with male interconnecting elements and that the upper and lower ends of the exit columns are configured with female interconnecting elements (see FIGS. 2 and 4). Configuring the entrance and exit columns in this manner greatly simplifies interconnection of the channel members in the correct manner because the upper end of an entrance column can only be interconnected with the lower end of an exit column. This configuration ensures that the channel members are assembled in a continuous downward path and also prevents two entrance columns from being connected together or two exit columns from being connected together. Therefore, as a child assembles the game it is impossible for him/her to interconnect the channel members in an incorrect manner. It is also pointed out that the male and female interconnecting elements could be interchanged on the entrance and exit columns, i.e. entrance column having female upper and lower ends and exit column having upper and lower male ends, and the same result would be achieved.

Figure 3:
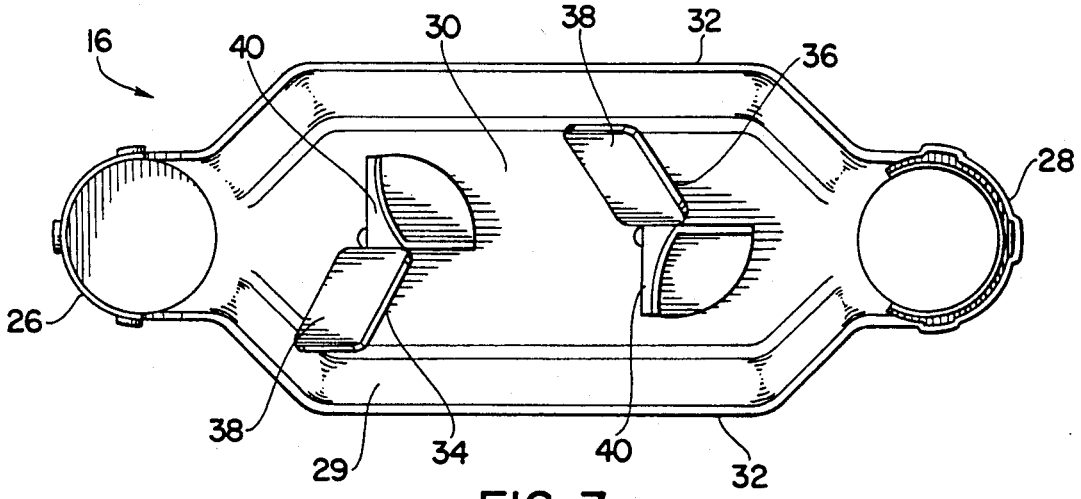
FIG. 3 is a top view thereof.

Referring now to FIGS. 2 and 3, the gate deflect channel member 16 comprises a channel portion 29 including a substantially flat, widened bottom wall 30 and a pair of spaced sidewalls 32 which connect the entrance column 26 thereof and the exit column 28 thereof, and two vertical gates 34 and 36 which project upwardly from the bottom wall 30. The gates 34 and 36 are respectively positioned within the channel portion 29 adjacent the entrance column 26 and the exit column 28, and they are further positioned adjacent to opposing sidewalls 32 of the channel portion 29. Each of the gates, 34 and 36, comprises a first deflector portion 38 which is angled to deflect a downwardly descending ball from the sidewall 32 of the channel portion 29 toward the center of the channel portion 29 and a second deflector portion 40 which is oriented perpendicular to the channel portion 29 to deflect the ball 21 from the center of the channel portion 29 toward the opposing sidewall 32 of the channel portion 29. In this regard, the gates, 34 and 36, cooperate to define a zig-zag ball path through the channel portion 29 and they are operative for alternately deflecting a ball 21 back-and-forth from one sidewall 32 of the channel portion 29 to the other sidewall 32 thereof as the ball 21 descends therethrough. Although only two gates, 34 and 36, are illustrated in the drawings, it is understood that other embodiments are contemplated wherein one or more additional gates are positioned adjacent alternating sidewalls 32 of the channel portion 29 to form longer, more complex zig-zag paths.

Figure 5:
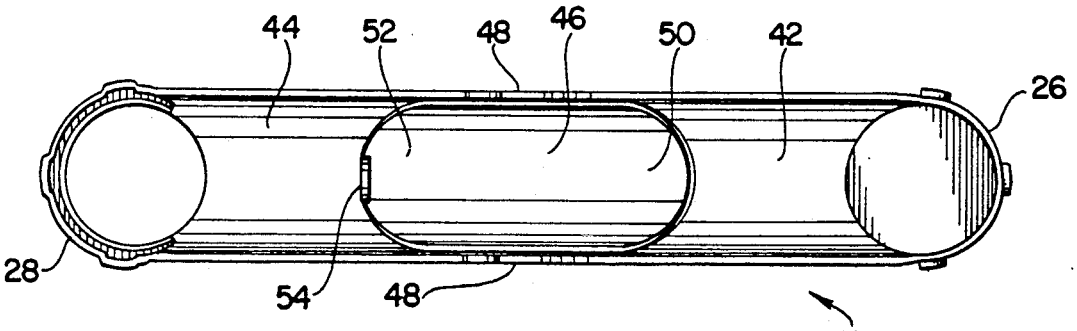
FIG. 5 is a top view thereof.

Turning now to FIGS. 4 and 5, the pivoting ramp channel member 18 comprises an upper level channel segment 42 adjacent an entrance column 26, a lower level channel segment 44 adjacent an exit column 28, and a pivoting ramp 46 which is operable for receiving a ball 21 descending along the upper level channel segment 42 and pivoting downwardly to deliver the ball 21 into the lower level channel segment 44. The ramp 46 is positioned between the upper level channel segment 42 and the lower level channel segment 44, and it is pivotally mounted between a pair of spaced parallel flanges 48 which project upwardly from opposite sides of the lower level channel segment 44. The ramp 46 includes a first end 50 positioned adjacent the upper level channel segment 42, and a second end 52 having a tab 54 extending angularly upwardly and outwardly therefrom. As the ball 21 descends along the upper level channel segment 42 it is received at the first end 50 of the ramp 46 and continues descending along the ramp 46. The weight of the ball 21 causes the second end 52 of the ramp 46 to pivot downwardly and release the ball into the lower level channel segment 44. The tab 52 operates to block the descent of the ball 21 along the ramp 46 until the second end 52 of the ramp 46 has fully pivoted to a position adjacent to the lower level channel segment 44.

It is seen therefore that gate deflect channel member and pivoting ramp channel member of the instant invention can be utilized individually, or in combination with each other, to effectively provide an amusing descending ball game apparatus. The gate deflect channel member 16 is operative for increasing the length of the ball path through the game apparatus 10 and it further provides for increased action movement of the ball 21, and the pivoting ramp channel member 18 also provides for increased action movement of the ball 21. Further, it can be seen that configuring the entrance and exit columns of the channel members so that the upper end of an entrance column of one channel can only be interconnected with the lower end of an exit column of another channel members effectively prevents the channel members from being assembled in an incorrect manner. For these reasons, it is believed that the descending ball game apparatus of the instant invention represents significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a descending ball game apparatus of a type which includes a ball and a plurality of downwardly sloped channel members which are interconnected by a plurality of substantially vertical columns, wherein the channel members and the columns cooperate to define at least one downwardly extending continuous path for guiding the ball in its downward travel, the improvement comprising:

at least one of said channel members comprising a channel portion having a bottom wall and opposing sidewalls, and further including at least two gates, each of which comprises a substantially vertical, fixed wall extending upwardly from said bottom wall, sequential gates being positioned adjacent opposite sidewalls of said channel portion, said gates being operative for alternately deflecting said ball back and forth from one sidewall of said channel portion to the opposing sidewall of said channel portion; and at least one of said channel members comprising a continuous channel portion having an upper level channel segment which is joined with a lower level channel segment, and a pivoting ramp positioned therebetween said ramp being operative for receiving a ball descending along said upper level channel segment and pivoting downwardly as said ball descends along said ramp to deliver said ball into said lower level channel segment.

2. In the descending ball game apparatus of claim 1, said gate deflect channel member comprising first and second gates respectively positioned adjacent spaced entrance and exit portions of said gate deflect channel member, respectively.

3. In the descending ball game apparatus of claim 1, said walls each comprising a first deflector portion angled to deflect a downwardly descending ball from one sidewall of said channel portion toward the opposite sidewall of said channel portion, and a second deflector portion oriented in substantially perpendicular relation to the longitudinal extent of said channel portion to further guide said downwardly descending ball toward said opposite sidewall of said channel portion.

4. In the descending ball game apparatus of claim 1, said ramp including first and second ends, said first end being positioned adjacent said upper level channel segment, said first end receiving a ball descending along said upper level channel segment, said second end pivoting downwardly toward said lower level channel segment as said ball descends along said ramp to deliver said ball into said lower level channel segment.

5. In the descending ball game apparatus of claim 4, said ramp channel further including a tab positioned adjacent said second end of said ramp for temporarily blocking the descent of said ball until said second end of said ramp is pivoted downwardly to a position adjacent said lower level channel segment.

6. In the descending ball game apparatus of claim 1, said lower level channel segment including a pair of spaced parallel flanges extending upwardly from opposing sides thereof, said pivoting ramp being pivotally mounted between said flanges.

7. In a descending ball game apparatus of a type which includes a ball and a plurality of downwardly sloped channel members which are interconnected by a plurality of substantially vertical columns, wherein the channel members and the columns cooperate to define at least one downwardly extending continuous path for guiding the ball in its downward travel, the improvement comprising:

at least one of said channel members comprising a gate deflect channel member including a channel portion having a bottom wall and opposing sidewalls, and further including at least two gates, each of which comprises a substantially vertical, fixed wall extending upwardly from said bottom wall, sequential gates being positioned adjacent opposite sidewalls of said channel portion, said gates being operative for alternately deflecting said ball back and forth from one sidewall of said channel portion to the opposing sidewall of said channel portion.

8. In the descending ball game apparatus of claim 7, said gate deflect channel member comprising first and second gates respectively positioned adjacent spaced entrance and exit portions of said gate deflect channel member respectively.

9. In the descending ball game apparatus of claim 7, said walls each comprising a first deflector portion angled to deflect a downwardly descending ball from one sidewall of said channel portion toward the opposite sidewall of said channel portion and a second deflector portion oriented in substantially perpendicular relation to the longitudinal extent of said channel portion to further guide said downwardly descending ball toward said opposite sidewall of said channel portion.

10. In a descending ball game apparatus of a type which includes a ball and a plurality of downwardly sloped channel members which are interconnected by a plurality of substantially vertical columns, wherein the channel members and the columns cooperate to define at least one downwardly extending continuous path for guiding the ball in its downward travel, the improvement comprising:

at least one of said channel members comprising a continuous channel portion having an upper level channel segment which is joined with a lower level channel segment, and a pivoting ramp positioned therebtween, said ramp being operative for receiving a ball descending along said upper level channel segment and pivoting downwardly as said ball descends along said ramp to deliver said ball into said lower level channel segment.

11. In the descending ball game apparatus of claim 10, said ramp including first and second ends, said first end being positioned adjacent said upper level channel segment, said first end receiving a ball descending along said upper level channel segment, said second end pivoting downwardly toward said lower level channel segment as said ball descends along said ramp to deliver said ball into said lower level channel segment.

12. In the descending ball game apparatus of claim 11, said ramp channel further including a tab positioned adjacent said second end of said ramp for temporarily blocking the descent of said ball until said second end of said ramp is pivoted downwardly to a position adjacent said lower level channel segment.

13. In the descending ball game apparatus of claim 10, said lower level channel segment including a pair of spaced parallel flanges extending upwardly from opposing sides thereof, said pivoting ramp being pivotally mounted between said flanges.

14. A descending ball game apparatus comprising a plurality of releasably interconnectable channel members, each of said channel members comprising;

an entrance column having upper and lower ends;

an exit column having upper and lower ends; and a downwardly-sloped channel segment extending from the entrance column of each channel member to the exit column thereof, the upper and lower ends of the entrance and exit columns of each channel member including interconnecting means for mating engagement of an entrance column of one channel member with an exit column of another channel member, the upper and lower ends of each entrance column having interconnecting means of one gender type and the upper and lower ends of each exit column having inter connecting means of an opposite gender type, whereby when assembling the channel members so that the channel segments face upwardly, the interconnecting means requires assembly of the channel members to form an assembled path in which each channel segment slopes downwardly from entrance to exit.

15. In the descending ball game apparatus of claim 14, said upper and lower ends of said entrance columns including male interconnecting means, said upper and lower ends of said exit columns including female interconnecting means.

* * * * *